US009472167B2

(12) United States Patent
Chandler

(10) Patent No.: US 9,472,167 B2
(45) Date of Patent: Oct. 18, 2016

(54) VIDEO CAPTURE THROUGH HARDWARE

(75) Inventor: Allan Thomas Chandler, Daglish (AU)

(73) Assignee: International Business Machines Corporation, Armonk, NY (US)

( * ) Notice: Subject to any disclaimer, the term of this patent is extended or adjusted under 35 U.S.C. 154(b) by 2119 days.

(21) Appl. No.: 12/425,866

(22) Filed: Apr. 17, 2009

(65) Prior Publication Data

US 2010/0265261 A1 Oct. 21, 2010

(51) Int. Cl.
*G09G 5/36* (2006.01)

(52) U.S. Cl.
CPC ..... *G09G 5/36* (2013.01); *G09G 2360/18* (2013.01); *G09G 2370/025* (2013.01)

(58) Field of Classification Search
CPC ..... G09G 5/39; G06F 8/38; G06F 3/0481
See application file for complete search history.

(56) References Cited

U.S. PATENT DOCUMENTS

| | | | | |
|---|---|---|---|---|
| 6,802,055 | B2 * | 10/2004 | Jade et al. | 717/130 |
| 7,233,336 | B2 | 6/2007 | Mondal | |
| 2007/0065102 | A1 | 3/2007 | Laughlin | |
| 2008/0134062 | A1 * | 6/2008 | Bauman et al. | 715/762 |

FOREIGN PATENT DOCUMENTS

| | | |
|---|---|---|
| WO | 9824231 | 6/1998 |

* cited by examiner

*Primary Examiner* — Matthew Salvucci
(74) *Attorney, Agent, or Firm* — Yee & Associates, P.C.; Stephen R. Yoder

(57) ABSTRACT

Activating a screen capture tool in a display adapter to capture information on a display. An operating system sends a command to the display adapter to initiate the capture of information from the graphical user interface of a display. The display adapter captures the information on the graphical user interface of the display. The information may be stored by the display adapter to a storage device that may be connected to the display adapter. The display is monitored for additional changes. Any changes that occur to the information on areas of the display may be captured and stored to the storage device. The operating system may enable the display adapter to retrieve the information stored in the storage device and/or play back the information retrieved to the display.

22 Claims, 6 Drawing Sheets

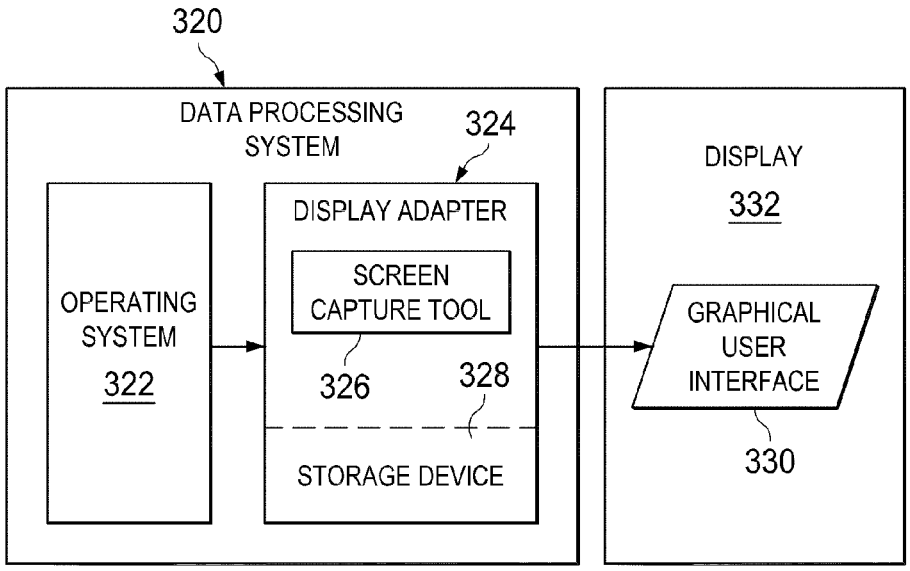
FIG. 3B
FIG. 3C
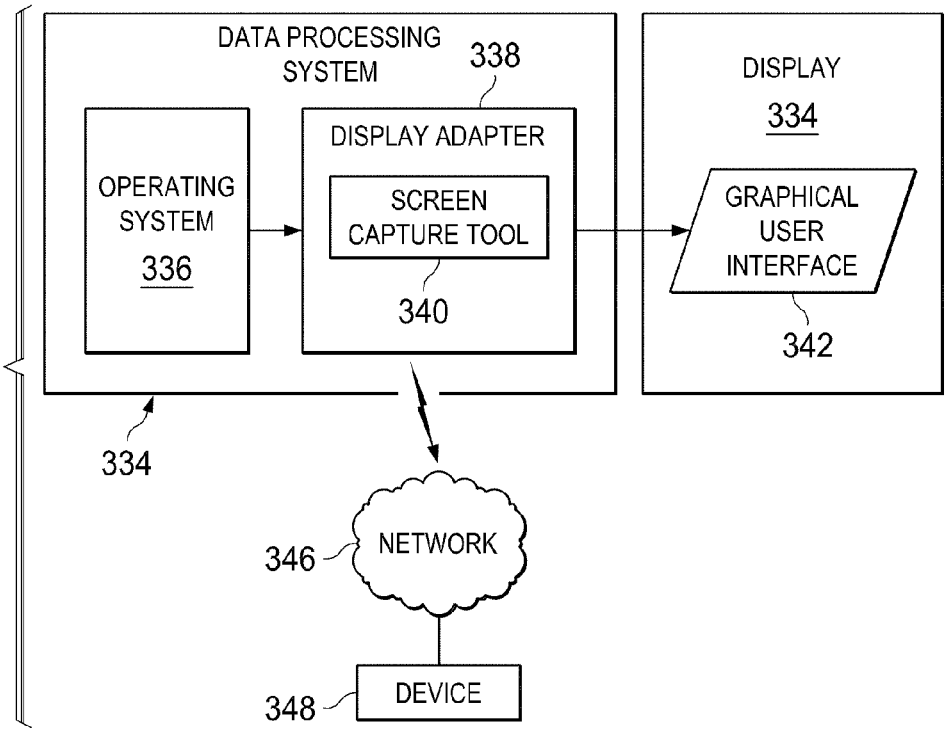

VIDEO CAPTURE THROUGH HARDWARE

BACKGROUND

1. Field

The present disclosure relates generally to image processing and more specifically to video stream capture through a display adapter.

2. Description of the Related Art

Screen capture tools may be used to capture video images displayed on a graphical user interface of a display. However, the operating system is not always aware of all the video information that may be displayed on a graphical user interface. There may be applications which bypass the operating system and directly communicate to the display adapter that is generating images on the graphical user interface. For example, an application may be configured to play back or display the contents of a digital video disc (DVD) or a movie file by sending the information directly to a display adapter rather than communicating through the operating system. Since the operating system is bypassed, the operating system cannot be aware of the information being sent by the application directly to the display adapter to the graphical user interface.

Therefore, screen capture tools that may query the operating system regarding information being generated to the graphical user interface by the display adapter would not receive information about any display that is being generated by the display adapter if the information is not being controlled by the operating system. Information captured from a graphical user interface by a screen capture tool that queries the operating system will not include any information that bypasses the operating system. The operating system may not have knowledge of any information or data sent directly through the display adapter to the graphical user interface.

When the information captured by the screen capture tool is played back to a display, information may be missing because the screen capture tool was not notified by the operating system that the information existed. The missing information may be displayed as areas of white space. Many existing systems with screen capture tools that operate in conjunction with an operating system cannot control the loss of information. Further, many systems do not recognize that information may be missing until the information captured by a screen capture tool is played back to a display.

SUMMARY

One or more illustrative embodiments for improving the capture of information from a display are disclosed. In one illustrative embodiment, a display adapter activates a screen capture tool that may reside in the display adapter. The screen capture tool in the display adapter may be configured by the operating system to capture information from a graphical user interface at a specific frame rate. The data or information captured from the graphical user interface may be stored in a frame buffer in the display adapter before being stored by the display adapter to a storage medium. The display adapter may retrieve information from the storage medium for playback to a graphical user interface and/or for transmission to the operating system.

In another illustrative embodiment, a system that captures information from a display is disclosed. The information may be video images or of some other type. The system comprises a display adapter that is configured to capture information from a display wherein the display includes a graphical user interface. The system also includes an operating system configured to control the operations of the display adapter; a screen capture tool communicatively coupled to the display adapter that enables the storage of information captured by the display adapter; and a storage device connected to the display adapter that stores information captured by the display adapter.

In another illustrative embodiment, an apparatus in a system environment captures information from a display. The information may be video data or of some other type. The apparatus comprises a microprocessor; an operating system, wherein the operating system is communicatively coupled to the microprocessor. The screen capture tool executed by the microprocessor to capture video information from the display, wherein the operating system is communicatively coupled to the screen capture tool; and a storage device, communicatively coupled to the screen capture tool, that stores the video information captured from the display through an operation of the screen capture tool.

In another illustrative embodiment, there is disclosed a method of capturing information on a display. The information may be images, video images, or video information. The method comprises actions of capturing, with a screen capture tool of a display adapter, information on a graphical user interface of the display to form captured information; storing the captured information to a storage device of the display adapter; monitoring the display for additional changes; capturing, to the storage device of the display adapter, an area of the graphical user interface that changes on the display; determining whether a command to terminate capturing the information has been received; and responsive to a determination that the command has been received, terminating capturing of the information.

In another illustrative embodiment, there is disclosed a method of retrieval from a display adapter. The method comprises initiating, through an operating system of a data processing system, a retrieval of information from a storage device; transferring the information retrieved from the storage device through a display adapter to a display for playback of the information; determining whether the transfer of information is complete; and responsive to the transfer of information being complete, notifying the operating system of a completion of the retrieval.

In another illustrative embodiment, there is disclosed a computer program product for capturing information from a display, the computer program product comprising a computer readable medium tangibly embodying computer executable instructions thereon. The computer executable instructions comprising instructions for capturing, with a screen capture tool of a display adapter, information on a graphical user interface of the display to form captured information; storing the captured information to a storage device of the display adapter; monitoring the display for additional changes; capturing, to the storage device of the display adapter, an area of the graphical user interface that changes on the display; determining whether a command to terminate capturing the information has been received; and responsive to a determination that the command has been received, terminating capturing of the information.

The illustrative embodiments of the disclosed processes and systems may provide for capturing information displayed on a graphical user interface without any loss of information. Additionally, the illustrative embodiments may provide for the efficient capture of content on a graphical user interface by executing software of the screen capture tool within a display adapter.

BRIEF DESCRIPTION OF THE SEVERAL VIEWS OF THE DRAWINGS

For a more complete understanding of this disclosure, reference is now made to the following brief description, taken in conjunction with the accompanying drawings and detailed description, wherein like reference numerals represent like parts.

FIG. 3B is a system configuration in which a display adapter may operate, wherein the storage is part of the display adapter, in accordance with an illustrative embodiment;

FIG. 3C is a system configuration in which a display adapter may operate, wherein a data processing system communicates through an interface of the display adapter to a network, in accordance with an illustrative embodiment;

DETAILED DESCRIPTION

Figure 1:
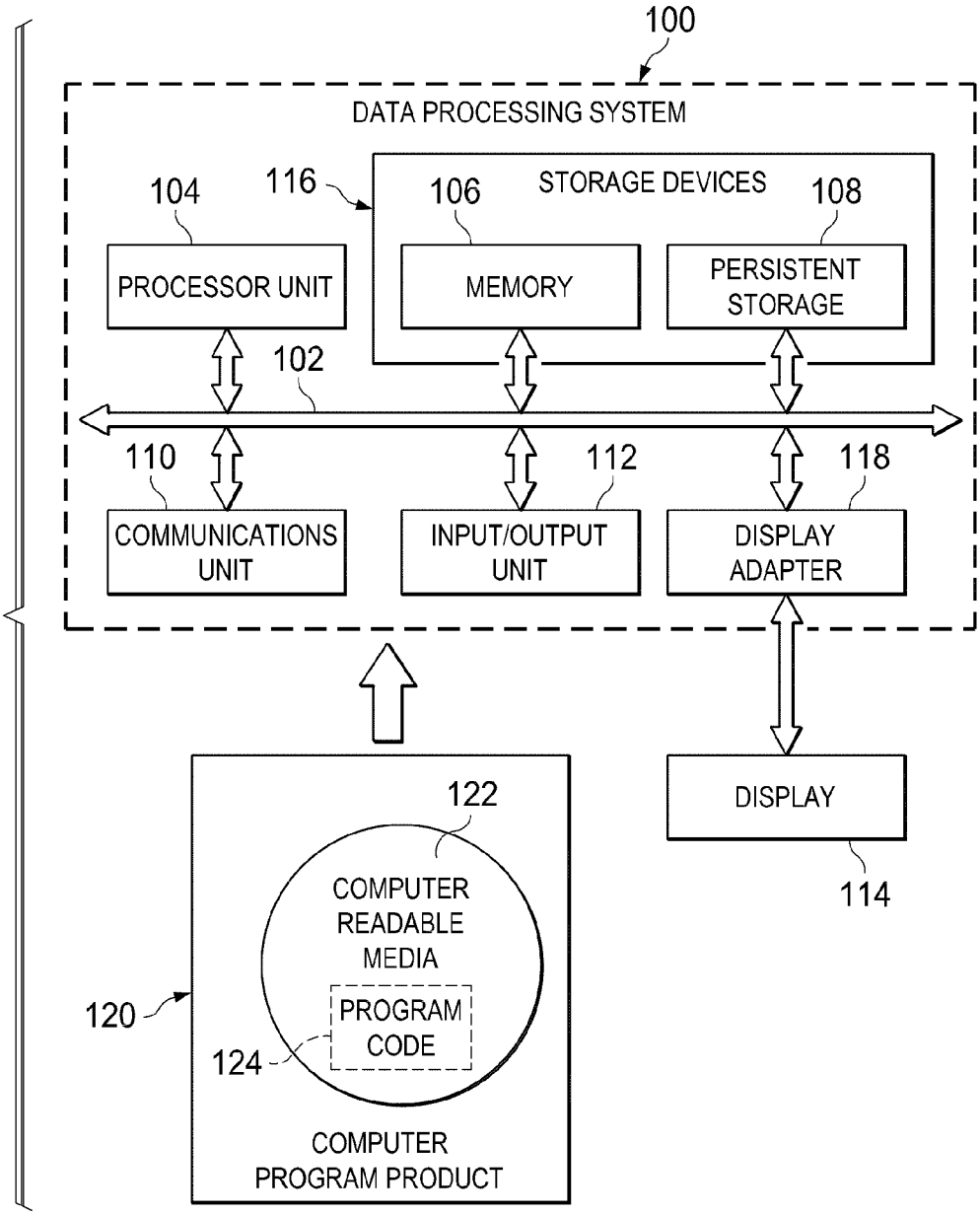
FIG. 1 is a block diagram of a data processing system depicted in accordance with an illustrative embodiment.

Although an illustrative implementation of one or more embodiments are provided below, the disclosed systems and/or methods may be implemented using any number of techniques. This disclosure should in no way be limited to the illustrative implementations, drawings, and techniques illustrated below, including the exemplary designs and implementations illustrated and described herein, but may be modified within the scope of the appended claims along with their full scope of equivalents.

As will be appreciated by one skilled in the art, the present disclosure may be embodied as a system, method or computer program product. Accordingly, the present disclosure may take the form of an entirely hardware embodiment, an entirely software embodiment (including firmware, resident software, micro-code, etc.) or an embodiment combining software and hardware aspects that may all generally be referred to herein as a "circuit," "module," or "system." Furthermore, the present disclosure may take the form of a computer program product tangibly embodied in any medium of expression with computer usable program code embodied in the medium.

Computer program code for carrying out operations of the present disclosure may be written in any combination of one or more programming languages, including an object oriented programming language such as Java™, Smalltalk, C++, or the like and conventional procedural programming languages, such as the "C" programming language or similar programming languages. Java™ and all Java™-based trademarks and logos are trademarks of Sun Microsystems, Inc., in the United States, other countries, or both. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

The present disclosure is described below with reference to flowchart illustrations and/or block diagrams of methods, apparatus, systems, and computer program products according to embodiments of the disclosure. It will be understood that each block of the flowchart illustrations and/or block diagrams, and combinations of blocks in the flowchart illustrations and/or block diagrams, can be implemented by computer program instructions.

These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer program instructions may also be stored in a computer-readable medium that can direct a computer or other programmable data processing apparatus to function in a particular manner, such that the instructions stored in the computer-readable medium produce an article of manufacture including instruction means which implement the function/act specified in the flowchart and/or block diagram block or blocks.

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide processes for implementing the functions/acts specified in the flowchart and/or block diagram block or blocks.

Screen capture is the recording of information that is displayed on an output device. The output device may be a display, and the display may output a graphical user interface. As used herein, a "display" is a device, such as a monitor, that displays data, image or video information. The information captured is stored as one or more still images or video. The captured information is stored, edited, and/or played back at a later time. Screen capture may be used for creating demonstrations of software or for making educational videos showing how software works. In an illustrative embodiment, "capturing" means copying and/or recording a data stream.

The embodiments of this disclosure execute a screen capture tool residing on the display adapter. The screen capture tool may be activated to capture information that is displayed on the graphical user interface. The information may be captured to a storage device for later retrieval during playback of the information.

With reference to FIG. 1, a block diagram of data processing system 100 depicted in accordance with an illustrative embodiment. In this illustrative example, data processing system 100 includes communications fabric 102, which provides communications between processor unit 104, memory 106, persistent storage 108, communications unit 110, input/output (I/O) unit 112, display adapter 118. Data processing system 100 is communicatively coupled to display 114 through display adapter 118. As used herein, "communicatively coupled" means capable of transmitting and/or receiving data and/or commands.

Processor unit 104 serves to execute instructions for software that are loaded into memory 106. Processor unit 104 may be a set of one or more processors or may be a multi-processor core, depending on the particular implementation. Further, processor unit 104 may be implemented using one or more heterogeneous processor systems in which a main processor is present with secondary processors on a single chip. As another illustrative example, processor unit 104 may be a symmetric multi-processor system containing multiple processors of the same type.

Memory 106 and persistent storage 108 are examples of storage devices 116. A storage device is any piece of hardware that is capable of storing information, such as, for example without limitation, data, program code in functional form, and/or other suitable information either on a temporary basis and/or a permanent basis. Memory 106, in these examples, may be, for example, a random access memory or any other suitable volatile or non-volatile storage device. Persistent storage 108 takes various forms depending on the particular implementation. For example, persistent storage 108 contains one or more components or devices. For example, persistent storage 108 is a hard drive, a flash memory, a rewritable optical disc, a rewritable magnetic tape, or some combination of the above. The media used by persistent storage 108 also may be removable. For example, a removable hard drive may be used for persistent storage 108.

Communications unit 110, in these examples, provides for communications with other data processing systems or devices. In these examples, communications unit 110 is a network interface card. Communications unit 110 provides communications through the use of either or both physical and wireless communications links.

Input/output unit 112 allows for input and output of data with other devices that are connected to data processing system 100. For example, input/output unit 112 provides a connection for user input through a keyboard, a mouse, and/or some other suitable input device. Further, input/output unit 112 sends output to a printer. Display 114 provides a mechanism to display information to a user on a screen. Display adapter 118 provides an image generation mechanism that generates images or receives images from an external source for output to display 114. Display adapter 118 includes internal storage such as a non-volatile memory or volatile memory, depending on the specific application in which the display adapter 118 is used. In embodiments of this disclosure display adapter 118 also includes a screen capture tool which may be executed to capture content from the display 114.

Instructions for the operating system, applications and/or programs may be located in storage devices 116, which are in communication with processor unit 104 through communications fabric 102. In these illustrative examples the instruction are in a functional form on persistent storage 108. These instructions may be loaded into memory 106 for execution by processor unit 104. The processes of the different embodiments may be performed by processor unit 104 using computer implemented instructions, which may be located in a memory, such as memory 106.

These instructions are referred to as program code, computer usable program code, or computer readable program code that may be read and executed by a processor in processor unit 104. The program code in the different embodiments may be embodied on different physical or tangible computer readable media, such as memory 106 or persistent storage 108.

Program code 124 is located in a functional form on computer readable media 122 that is selectively removable and is loaded onto or transferred to data processing system 100 for execution by processor unit 104. Program code 124 and computer readable media 122 form computer program product 120 in these examples. In one example, computer readable media 122 is in a tangible form, such as, for example, an optical or magnetic disc that is inserted or placed into a drive or other device that is part of persistent storage 108 for transfer onto a storage device, such as a hard drive that is part of persistent storage 108. In a tangible form, computer readable media 122 also takes the form of a persistent storage, such as a hard drive, a thumb drive, or a flash memory that is connected to data processing system 100. The tangible form of computer readable media 122 is also referred to as computer recordable storage media. In some instances, computer readable media 122 is not removable.

Alternatively, program code 124 may be transferred to data processing system 100 from computer readable media 122 through a communications link to communications unit 110 and/or through a connection to input/output unit 112. The communications link and/or the connection may be physical or wireless in the illustrative examples. The computer readable media also may take the form of non-tangible media, such as communication links or wireless transmissions containing the program code.

In some illustrative embodiments, program code 124 is downloaded over a network to persistent storage 108 from another device or data processing system for use within data processing system 100. For instance, program code stored in a computer readable storage medium in a server data processing system may be downloaded over a network from the server to data processing system 100. The data processing system providing program code 124 may be a server computer, a client computer, or some other device capable of storing and transmitting program code 124.

The different components illustrated for data processing system 100 are not meant to provide architectural limitations to the manner in which different embodiments are implemented. The different illustrative embodiments may be implemented in a data processing system including components in addition to, or in place of, those illustrated for data processing system 100. Other components shown in FIG. 1 can be varied from the illustrative examples shown. The different embodiments may be implemented using any hardware device or system capable of executing program code. As one example, the data processing system may include organic components integrated with inorganic components and/or may be comprised entirely of organic components excluding a human being. For example, a storage device may be comprised of an organic semiconductor.

As another example, a storage device in data processing system 100 is any hardware apparatus that stores data. Memory 106, persistent storage 108 and computer readable media 122 are examples of storage devices in a tangible form.

In another example, a bus system is used to implement communications fabric 102 and may be comprised of one or more buses, such as a system bus or an input/output bus. Of course, the bus system may be implemented using any suitable type of architecture that provides for a transfer of data between different components or devices attached to the bus system. Additionally, a communications unit may include one or more devices used to transmit and receive data, such as a modem or a network adapter. Further, a memory may be, for example, memory 106 or a cache such as found in an interface and memory controller hub that are present in communications fabric 102.

Figure 2:
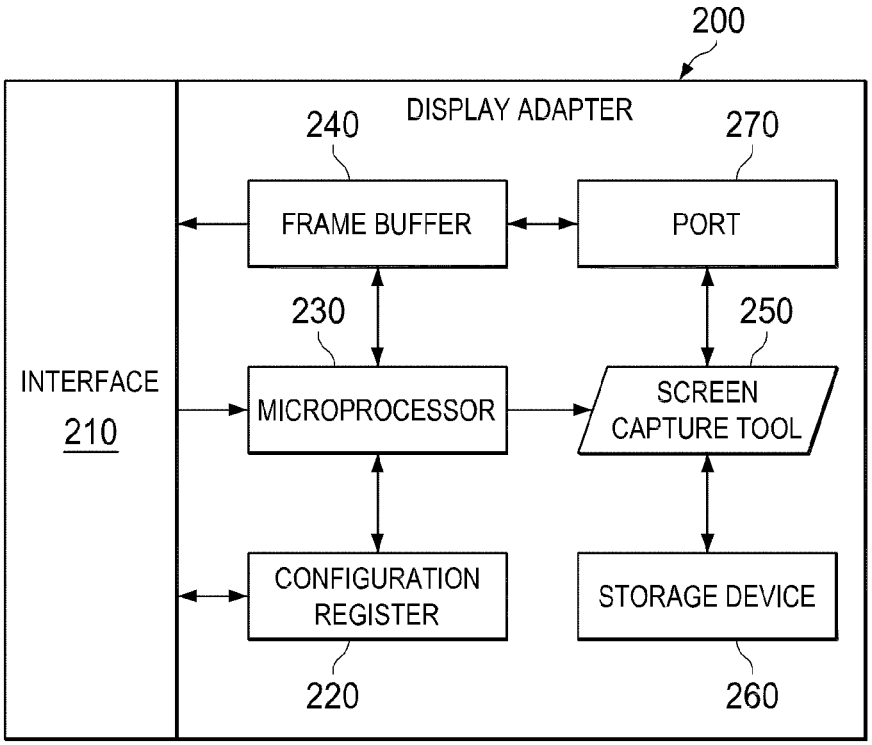
FIG. 2 is a component view of a display adapter in accordance with an illustrative embodiment.

FIG. 2 is a component view of display adapter 200 in accordance with an illustrative embodiment. Display adapter 200 generates images that are displayed on a graphical user interface. Display adapter 200 may be implemented as display adapter 118, as shown in FIG. 1. Display adapter 200 is installed in an operating system with specific drivers required for proper performance of the display adapter 200. Display adapter 200 communicates with an application programming interface 210 that enables the drivers for the display adapter 200 and other components of the operating system environment to communicate with the display adapter 200. The display adapter 200 also includes configuration register 220. In some embodiments, configuration register 220 may be implemented as programmable logic such as a programmable logic array, a programmable logic device, or other such programmable logic as would be recognized by one skilled in the art. Display adapter 200 also includes a frame buffer 240 for temporary storage of information, a microprocessor 230, and a screen capture tool 250 that is enabled by microprocessor 230. In some embodiments, display adapter 200 also includes a storage device 260 and port 270. Storage device 260 is used to store information captured by screen capture tool 250. Port 270 is an interface through which information is transferred between display adapter 200 and other devices. Information in storage device 260 is retrieved by screen capture tool 250 for playback. Display adapter 200 receives commands through interface 210 that enable screen capture tool 250 to be activated to capture information from a graphical user interface. Information captured to display adapter 200 is stored in storage device 260 or in some other storage device that may be connected to display adapter 200. Configuration register 220 includes programmable settings that determine the rate at which the screen capture tool 250 stores information from a graphical user interface or captures information from a graphical user interface. Configuration register 220 may also be used to establish a compression strategy that may be used to store information in storage device 260. Frame buffer 240 is used for temporary storage of information from a storage device 260 or from information captured by screen capture tool 250 from a screen of a graphical user interface.

Figure 3A:
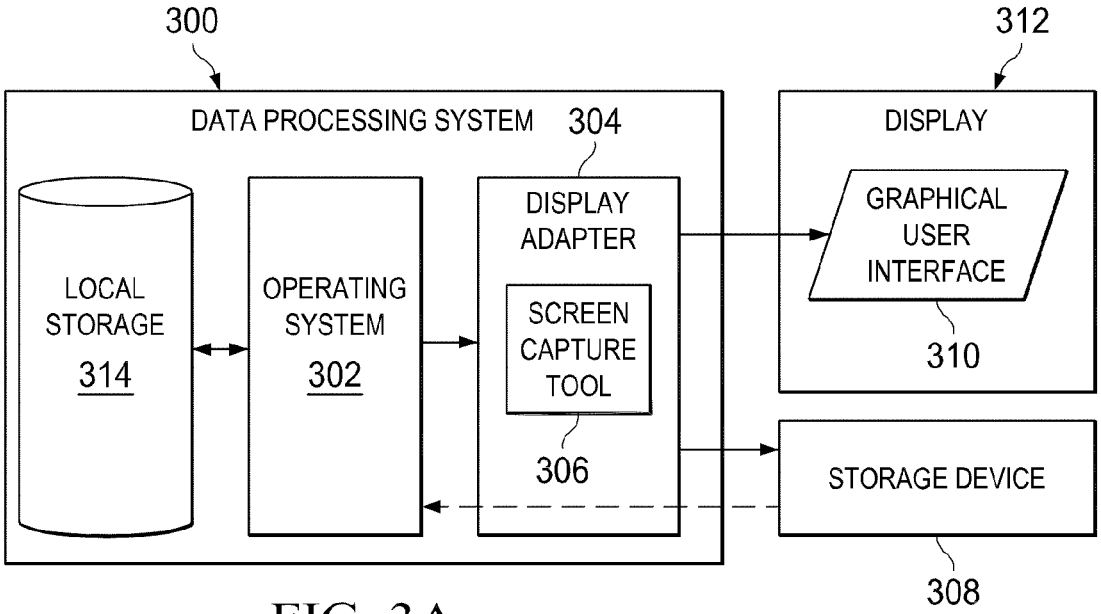
FIG. 3A is a system configuration in which a display adapter may operate in accordance with an illustrative embodiment.

FIGS. 3A, 3B, and 3C illustrate various system configurations in which a display adapter may operate. It must be noted that these system configurations are not intended to be limiting. Other system configurations may be possible as would be apparent to one skilled in the art.

FIG. 3A is a system configuration in which display adapter 304 may operate in accordance with an illustrative embodiment. Data processing system 300 includes operating system 302, local storage 314, and display adapter 304. Data processing system 300 may be data processing system 100, as shown in FIG. 1. Display adapter 304 may be display adapter 118, as shown in FIG. 1. Display 312 may be display 114 as shown in FIG. 1. Local storage 314 may be storage devices 116, as shown in FIG. 1. Operating system 302 is communicatively coupled to display adapter 304. In one embodiment, display adapter 304 includes screen capture tool 306. Screen capture tool 306 may be screen capture tool 250, as shown in FIG. 2. Display 312 includes graphical user interface 310 and is communicatively coupled to data processing system 300 to receive video display information from display adapter 304. Operating system 302 of data processing system 300 sends a signal or command to screen capture tool 306 in display adapter 304. The operating system may use an application programming interface to send the signal or command. In another illustrative embodiment, the operating system sends the signal or command by entering the command into the command stream of the microprocessor 230 of display adapter 200, as shown in FIG. 2. The command from the operating system enables screen capture tool 306 to start capturing information from an area of the graphical user interface 310 of display 312. In one illustrative embodiment, the area of the graphical user interface 310 that changes comprises all of the graphical user interface 310. In another embodiment, the area of the graphical user interface 310 represents several areas of the graphical user interface 310 that may be contiguous or non-contiguous. In an embodiment, an area of the of graphical user interface 310 of display 312 is designated by a user or configured through the display adapter 304. In another embodiment, information from storage device 308 is retrieved by the operating system 302 and stored to a local storage 314. The information may be retrieved from local storage 314 at a later time for playback and/or editing or other type of manipulation.

Display adapter 304 controls the storage of information from the screen of graphical user interface 310 to storage device 308. Operating system 302 sends a control signal to screen capture tool 306 to stop a capture of information from graphical user interface 310. Operating system 302 sends a command to playback information stored in storage device 308. In an embodiment, the information from storage device 308 is directly retrieved to display adapter 304 and displayed on a screen of graphical user interface 310. In another embodiment, information from storage device 308 is retrieved by the operating system 302 and sent to display adapter 304 for display on a screen of graphical user interface 310.

FIG. 3B is a system configuration in which display adapter 304 may operate, wherein storage device 328 is part of display adapter 324, in accordance with an illustrative embodiment. Display adapter 324 and data processing system 320 include screen capture tool 326 and storage device 328. Data processing system 320 may be data processing system 100, as shown in FIG. 1. Display adapter 304 may be display adapter 118, as shown in FIG. 1. Display 332 may be display 114, as shown in FIG. 1. Screen capture tool 326 may be screen capture tool 250, as shown in FIG. 2. Operating system 322 starts the capture of information on a screen of graphical user interface 330 by activating screen capture tool 326 in display adapter 324. Operating system 322 also controls when screen capture tool 326 stops the capture of information from the graphical user interface 330 of display 332. Information captured by using the screen capture tool 326 is stored in storage device 328 that is communicatively coupled to display adapter 324.

FIG. 3C is a system configuration in which display adapter 304 may operate, wherein, data processing system 334 communicates through an interface of the display adapter 338 to network 346, in accordance with an illustrative embodiment. Communication through the network allows communication to one or more devices such as device 348. Data processing system 334 may be data processing system 100, as shown in FIG. 1. Display adapter 304 may be display adapter 118, as shown in FIG. 1. Display 344 may be display 114, as shown in FIG. 1. Device 348 is a storage means, a component that has a means of storing information, or some other type of storage known to one skilled in the art. Operating system 336 commands screen capture tool 340 in display adapter 338 to begin capture of information from a graphical user interface 342 of display 344. Screen capture tool 340 may be screen capture tool 250, as shown in FIG. 2. Information that is retrieved from an area of graphical user interface 342 is retrieved to display adapter 338. The information is downloaded to network 346 and stored in a storage device such as device 348. Operating system 336 also provides commands to screen capture tool 340 that enables playback of information stored in device 348 to an area of graphical user interface 342.

Information stored in a storage device may implement various compression strategies. The information may consist of frames of image data. In an illustrative embodiment, the screen capture tool chooses a compression strategy each time information is captured based on one or more flags in the configuration register of the display adapter.

In another illustrative embodiment, the second flag is referred to as a "NO_CHANGE" flag. While the "NO_CHANGE" flag is set, only indicators that the image data has not changed, are stored. The "NO_CHANGE" flag remains set until there is a change to the captured image data. Once there is a change to the captured image data, the "NO_CHANGE" flag is cleared. The "NO_CHANGE" flag is set after each frame is stored.

In another illustrative embodiment, a change to the captured image data results from a change to the graphical user interface. When the "NO_CHANGE" flag is not set, the display adapter compresses information stored, for example, by determining and storing only the smallest rectangle on the display screen that contains picture elements or pixels that were changed.

For example, when a frame is stored, four values are stored and set to a special value, such as 65535 or −1. The four values represent the size of the smallest rectangle encompassing pixel changes. The four values are a set of row and column values. For example, the four values may be the following: 10 for the start row, 20 for the end row, 5 for the start column, and 15 for the end column. When a pixel is changed and the coordinates of the pixel are outside of the rectangle represented by the four values, some of the four values are changed so that the rectangle now encompasses the changed pixel. Table 1, illustrated below, is instructive of the disclosed example.

TABLE 1

| Event | Minimum rectangle |
|---|---|
| Capture start | (−1, −1) to (−1, −1) |
| Change pixel (10, 15) | (10, 15) to (10, 15) |
| Change pixel (20, 5) | (10, 5) to (20, 15) |
| Change pixel (15, 7) | No change since that already within the rectangle. |
| Change pixel (15, 99) | (10, 5) to (20, 99) |
| Store frame (10, 5) to (20, 99) | (−1, −1) to (−1, −1) |

It must be noted that the disclosed compression strategy represents only one preferred embodiment and the discussed strategies should not be construed as architectural limitations. Other strategies may be evident to one skilled in the art. Compression strategies may be chosen on a frame-by-frame basis to minimize storage or maximize speed.

Figure 4:
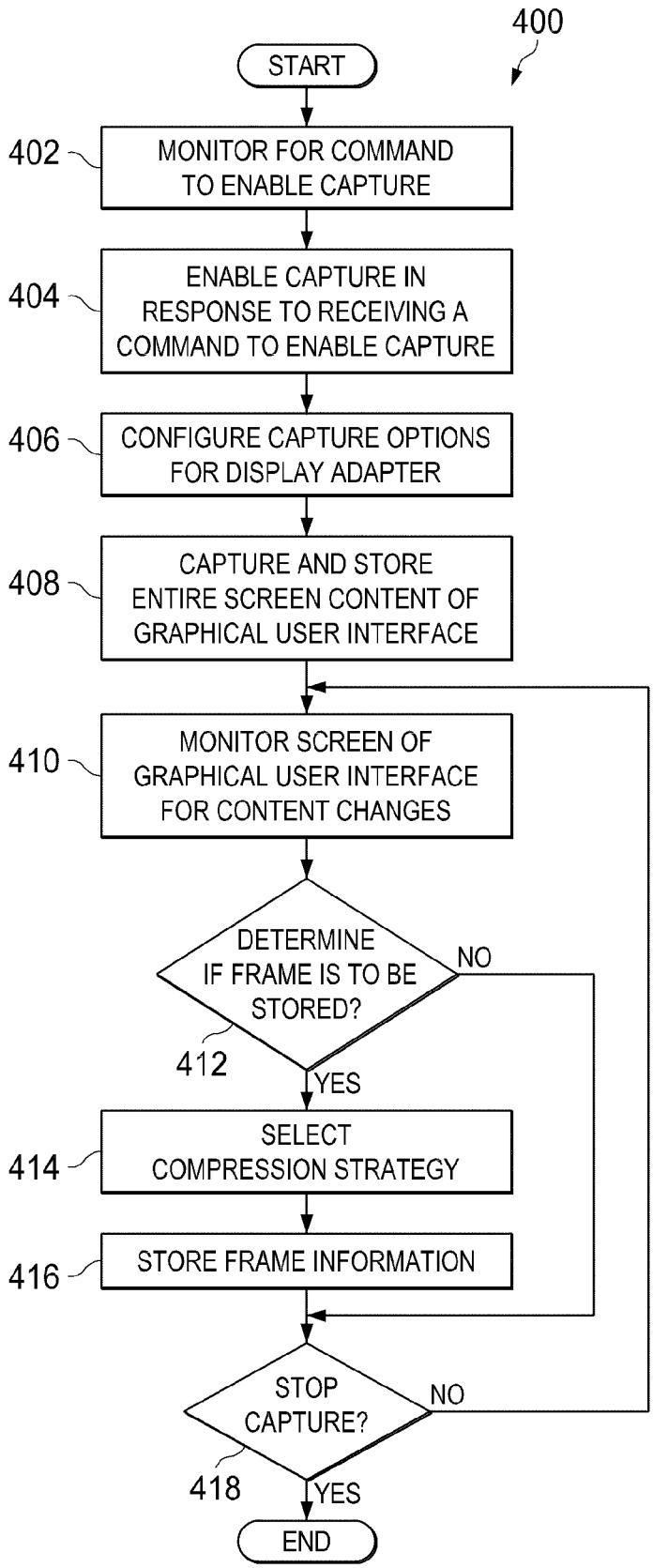
FIG. 4 is a flowchart of a method for capturing display information in accordance with an illustrative embodiment.

FIG. 4 is a flowchart of method 400 for capturing display information in accordance with an illustrative embodiment. The process begins by a screen capture tool on a display adapter monitoring for a command from an operating system to enable the capture of information from a display of a graphical user interface at step 402. Responsive to receiving a command to enable capture, the screen capture tool enables capture at step 404. At step 406, the screen capture tool configures capture options in the display adapter through a configuration register or some other programmable logical array or device. The screen capture tool may configure capture options related to the rate at which frames of information are captured from a graphical user interface and stored to a storage device. The capture of information may also be obtained from the output of the display adapter, the display adapter frame buffer, and/or any other mechanism for capturing information. At step 408, the entire screen content of the graphical user interface is initially captured and stored to a storage device. The screen of the graphical user interface is monitored for content changes at step 410. At step 412, a determination is made whether a frame needs to be captured. If a frame does not need to be captured at step 412, a determination is made whether a command to stop capture has been received at step 418. The determination may be, for example, in response to a user input, such as the user setting a time for the capture to stop and/or the user selecting the stop command at the moment the user wants the capture to stop. Herein, the word "stop" is used interchangeably with the word "terminate". If a frame is to be captured at step 412, a compression strategy is selected at step 414. The frame information is stored to a storage device using the selected compression strategy at step 416. A determination is made whether a command to stop capture has been received at step 418. If a command to stop capture has not been received, then the process continues at step 410 with the monitoring of a screen of a graphical user interface for content changes. If a command to stop capture has been received at step 418, the process terminates.

Figure 5:
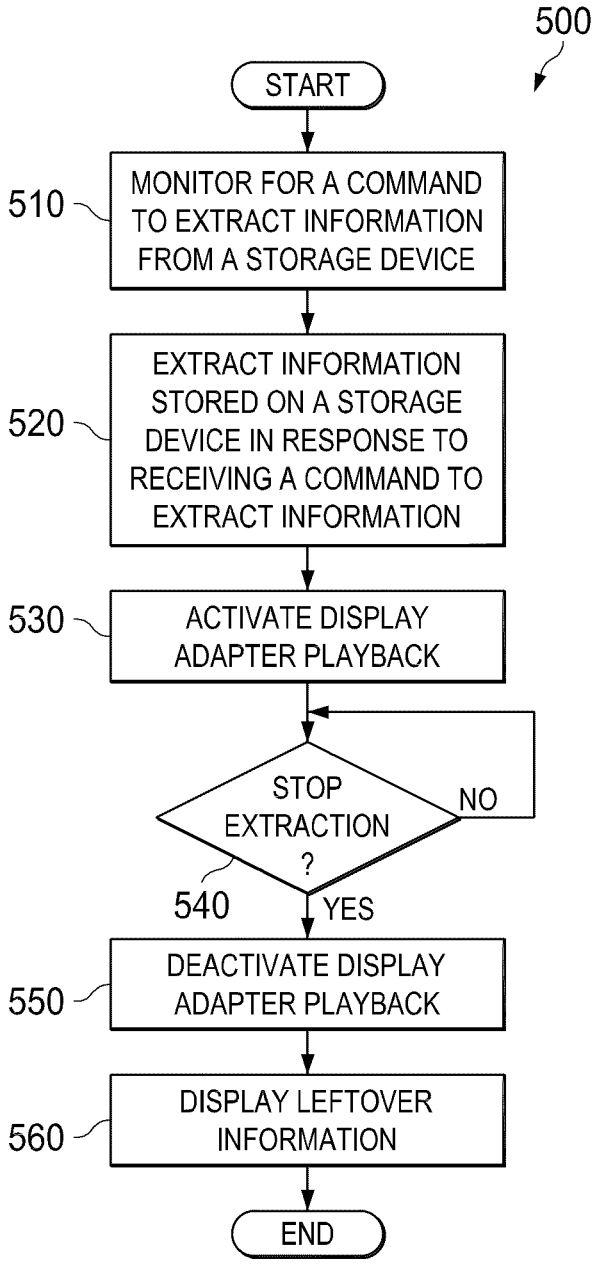
FIG. 5 is a flowchart of a method for illustrating a playback sequence in accordance with an illustrative embodiment.

FIG. 5 is a flowchart of method 500 for illustrating a playback sequence in accordance with an illustrative embodiment. The process starts with a screen capture tool on a display adapter monitoring for a command to extract information from a storage device at step 510. Responsive to receiving a command to extract information, the screen capture tool extracts information stored on the storage device at step 520. The storage device may be integrated with the display adapter. In another embodiment, the storage device is communicatively coupled to the display adapter through a port. Other embodiments may include a storage device that is coupled to the display adapter through a network. At step 530, display adapter playback is activated by filling the frame buffer with the extracted information from the storage device so the information may be displayed. At step 540, the screen capture tool determines whether a command to terminate the extraction of information has been received. If no command to terminate has been received, step 540 continues to be executed until the command to terminate is received. If the command to terminate the extraction of information has been received, the screen capture tool deactivates display adapter playback at step 550. When extraction is terminated, leftover information may remain in the frame buffer that was not displayed on the screen prior to the termination. Leftover information in the frame buffer of the display adapter is displayed on the screen at step 560. The process terminates thereafter.

Figure 6:
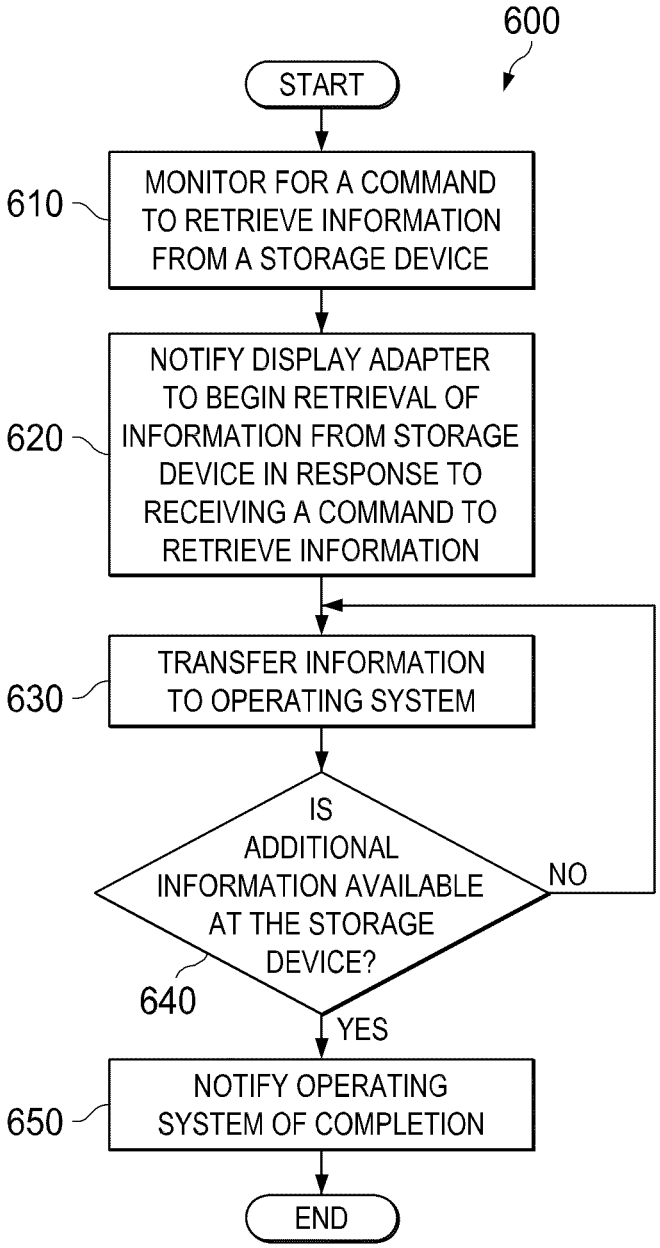
FIG. 6 is a flowchart of a method for illustrating a retrieval sequence in accordance with an illustrative embodiment.

FIG. 6 is a flowchart of method 600 for illustrating a retrieval sequence in accordance with an illustrative embodiment. The process starts with the screen capture tool monitoring for a command from the operating system to retrieve information from a storage device at step 610. The screen capture tool retrieves information from the storage device in response to receiving a command to retrieve information from a storage device at step 620. In one embodiment, the storage device is integrated with the display adapter. In one embodiment, the storage device is communicatively coupled to the display adapter through a port. In another embodiment, the storage device is coupled to the display adapter through a network. At step 630, the information extracted from the storage device is transferred to the operating system. It is determined at step 640 whether additional information from the storage device is available for transfer. If additional information is available at the storage device, the process returns to step 630 to transfer the additional information to the operating system. If there is no additional information available from the storage device at step 640, the operating system is notified that the transfer of information is complete at step 650. The process terminates thereafter.

One or more illustrative embodiments may provide the ability to capture all information being displayed on the computer screen by ensuring it's captured at the level where all information is available. Also, one or more illustrative embodiments may capture the information in an efficient manner by offloading the capture work from the operating system to specialized hardware and software. Also, one or more illustrative embodiments may minimize unnecessary communication between the operating system and the capture device.

The flowchart and block diagrams in the figures illustrate the architecture, functionality, and operation of possible implementations of systems, methods and computer program products according to various embodiments of the present disclosure. In this regard, each block in the flowchart or block diagrams may represent a module, segment, or portion of code, which comprises one or more executable instructions for implementing a specified logical function. It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the embodiments disclosed herein. Many modifications and variations will be apparent to those of ordinary skill in the art without departing from the scope and spirit of the disclosure.

The embodiments of the disclosure can take the form of an entirely hardware embodiment, an entirely software embodiment or an embodiment containing both hardware and software elements. In a preferred embodiment, the disclosure may be implemented in software, which includes but is not limited to firmware, resident software, microcode, and other software media that may be recognized by one skilled in the art.

It is important to note that while the present disclosure has been described in the context of a fully functioning data processing system, those of ordinary skill in the art will appreciate that the processes of the present disclosure are capable of being distributed in the form of a computer readable medium of instructions and a variety of forms and that the present disclosure applies equally regardless of the particular type of signal bearing media actually used to carry out the distribution. Examples of computer readable media include recordable-type media, such as a floppy disc, a hard disc drive, a RAM, CD-ROMs, DVD-ROMs, and transmission-type media, such as digital and analog communications links, wired or wireless communications links using transmission forms, such as, for example, radio frequency and light wave transmissions. The computer readable media may take the form of coded formats that are decoded for actual use in a particular data processing system.

A data processing system suitable for storing and/or executing program code will include at least one processor coupled directly or indirectly to memory elements through a system bus. The memory elements can include local memory employed during actual execution of the program code, bulk storage, and cache memories which provide temporary storage of at least some program code in order to reduce the number of times code must be retrieved from bulk storage during execution.

Input/output or I/O devices (including but not limited to keyboards, displays, pointing devices, etc.) can be coupled to the system either directly or through intervening I/O controllers.

Network adapters may also be coupled to the system to enable the data processing system to become coupled to other data processing systems or remote printers or storage devices through intervening private or public networks. Modems, cable modem and Ethernet cards are just a few of the currently available types of network adapters.

The disclosure has been presented for purposes of illustration and description, and is not intended to be exhaustive or limited to the embodiments disclosed. Many modifications and variations will be apparent to those of ordinary skill in the art. The embodiments were chosen and described in order to best explain the basic principles and practical applications, and to enable others of ordinary skill in the art to understand the various embodiments with various modifications as are suited to the particular use contemplated.

What is claimed is:

1. A system that captures information from a display, the system comprising:

a display adapter configured to capture information sent from the display adapter to a display, the display comprising a graphical user interface and the information comprising bit data;

an operating system configured to control operations of the display adapter and to send instructions to the display adapter for generating the information;

a screen capture tool communicatively coupled to the display adapter that enables storage of the information captured by the display adapter; and a storage device connected to the display adapter that stores the information captured by the display adapter.

2. The system of claim 1, wherein the screen capture tool is integrated within the display adapter.

3. The system of claim 2, wherein the operating system enables the screen capture tool of the display adapter to capture information from the display.

4. The system of claim 1, wherein the display adapter communicates with an application programming interface that receives instructions from the operating system.

5. The system of claim 1, wherein the storage device is communicatively coupled to the display adapter through a network.

6. The system of claim 1, wherein the storage device is integrated within the display adapter.

7. An apparatus in a system environment that captures information from a display, the apparatus comprising:

a microprocessor;

an operating system, wherein the operating system is communicatively coupled to the microprocessor and to a display adapter configured to receive instructions from the operating system and to generate information in response to the instructions and to send the information to the display, the display comprising a graphical user interface and the information comprising bit data;

a screen capture tool in the display adapter, wherein the screen capture tool is executed by the microprocessor to capture information sent from the display adapter to the display, and wherein the screen capture tool is communicatively coupled to the operating system; and a storage device, wherein the storage device is communicatively coupled to the screen capture tool, and wherein the storage device stores the information captured from the display through the screen capture tool.

8. The apparatus of claim 7, further comprising:

a configuration register that configures features of the screen capture tool; and a frame buffer that stores the information temporarily.

9. The apparatus of claim 8, wherein the information is video information and a configured feature of the screen capture tool comprises a rate of capture of frame information for the display.

10. In a data processing system, a method of capturing information from a display, the method comprising:

capturing, with a screen capture tool of a display adapter, the information from a graphical user interface of the display to form captured information, wherein the information is bit data generated by the display adapter in response to instructions received from an operating system;

storing the captured information to a storage device of the display adapter;

monitoring the display for changes;

capturing, to the storage device of the display adapter, an area of the graphical user interface that changes on the display;

determining whether a command to terminate capturing the information has been received; and responsive to a determination that the command has been received, terminating capturing of the information.

11. The method of claim 10, further comprising:

retrieving, to a storage device controlled by the operating system, the captured information being stored in the storage device of the display adapter.

12. The method of claim 10, further comprising:

selecting a compression strategy; and storing the area of the graphical user interface that changes on the display based on the selected compression strategy.

13. The method of claim 10, wherein the area of the graphical user interface is all of the graphical user interface.

14. The method of claim 10, wherein the area comprises a set of contiguous areas of the graphical user interface.

15. The method of claim 10, wherein the area comprises a set of non-contiguous areas of the graphical user interface.

16. The method of claim 10, further comprising:

monitoring, with the screen capture tool, for an extract command;

responsive to receiving the extract command, extracting the captured information;

activating a display adapter playback, wherein activating the display adapter playback comprises filling a frame buffer of the display adapter and displaying the captured information from the frame buffer;

determining whether a terminate extraction command has been received;

responsive to receiving terminate extraction command, deactivating the display adapter playback; and displaying a leftover information from the frame buffer.

17. A computer program product for capturing information from a display, the computer program product comprising:

a computer-readable storage device tangibly embodying computer executable instructions thereon, the computer executable instructions comprising instructions for:

capturing, with a screen capture tool of a display adapter, information from a graphical user interface of the display to form captured information, wherein the information is bit data generated by the display adapter in response to instructions received by the display adapter from an operating system;

storing the captured information to a storage device of the display adapter;

monitoring the display for additional changes;

capturing, to the storage device of the display adapter, an area of the graphical user interface that changes on the display;

determining whether a command to terminate capturing the information has been received; and responsive to a determination that the command has been received, terminating capturing of the information.

18. The computer program product of claim 17, further comprising instructions for:

selecting a compression strategy; and storing the area of the graphical user interface that changes on the display based on the selected compression strategy.

19. The computer program product of claim 18, wherein the information is stored to a storage device controlled by the operating system.

20. The computer program product of claim 17, further comprising instructions for:

initiating, through an operating system of the data processing system, a retrieval of information from a storage device; and transferring the information retrieved from the storage device through the display adapter to the operating system for playback of the information.

21. The computer program product of claim 20, wherein transferring the information comprises retrieving the information from a storage device that is within the display adapter.

22. The computer program product of claim 20, further comprising instructions for: determining whether a transfer of the information is complete; and responsive to the transfer of the information being complete, notifying the operating system of a completion of the retrieval.

* * * * *